US010662658B2

(12) United States Patent
Hyvönen et al.

(10) Patent No.: US 10,662,658 B2
(45) Date of Patent: May 26, 2020

(54) SCAFFOLD FOR SUPPORTING A WORKING PLATFORM FOR BRIDGES

(71) Applicant: Fast Beam Oy, Klaukkala (FI)

(72) Inventors: Antti Hyvönen, Klaukkala (FI); Timo Siltala, Jyväskylä (FI)

(73) Assignee: FAST BEAM OY, Klaukkala (FI)

( * ) Notice: Subject to any disclaimer, the term of this patent is extended or adjusted under 35 U.S.C. 154(b) by 269 days.

(21) Appl. No.: 15/500,540

(22) PCT Filed: Aug. 6, 2015

(86) PCT No.: PCT/FI2015/050518

§ 371 (c)(1),
(2) Date: Jan. 31, 2017

(87) PCT Pub. No.: WO2016/020578

PCT Pub. Date: Feb. 11, 2016

(65) Prior Publication Data

US 2017/0226756 A1 Aug. 10, 2017

(30) Foreign Application Priority Data

Aug. 6, 2014 (FI) ..... 20145705

(51) Int. Cl.

| | |
|---|---|
| ***E04G 5/00*** | (2006.01) |
| ***E04G 3/28*** | (2006.01) |
| ***E01D 19/10*** | (2006.01) |
| *E04G 3/34* | (2006.01) |

(52) U.S. Cl.

CPC ..... *E04G 3/28* (2013.01); *E01D 19/106* (2013.01); *E04G 3/34* (2013.01); *E04G 2003/286* (2013.01)

(58) Field of Classification Search

CPC ..... E04G 21/3219; E04G 5/064; E04G 3/28; E04G 3/34; E04G 2003/286; E04G 5/007; E04G 3/24; E04G 3/243; E04G 5/006; E01D 19/106; E01D 22/00

See application file for complete search history.

(56) References Cited

U.S. PATENT DOCUMENTS 3,043,395 A 7/1962 Volkel
3,357,517 A * 12/1967 Wagner ..... B66F 11/044 182/2.6
4,154,318 A * 5/1979 Malleone ..... E04G 3/28 182/12

(Continued)

FOREIGN PATENT DOCUMENTS

EP 1215354 A2 6/2002
EP 1482104 A1 12/2004

(Continued)

OTHER PUBLICATIONS

Russian Official Action—2016105165/03 (008348)—dated Mar. 29, 2018.

*Primary Examiner* — Daniel P Cahn
(74) *Attorney, Agent, or Firm* — Young & Thompson

(57) ABSTRACT

A scaffolding to be fastened to a bridge or the like deck structure comprises a boom system (2) for supporting the working platforms and the support structures needed for the work and for fastening the boom system of the fastening body (1) to the upper surface of the deck structure. The boom system (2) is connected to the fastening body via a swivel quadrangle (3, 6, 11, 12).

11 Claims, 4 Drawing Sheets

(56) References Cited

U.S. PATENT DOCUMENTS

| | | | | |
|---|---|---|---|---|
| 4,168,764 | A | 9/1979 | Walters | |
| 4,217,971 | A | 8/1980 | Rivinius | |
| 4,569,416 | A * | 2/1986 | Stokoe | B66F 17/006 182/2.9 |
| 5,104,089 | A | 4/1992 | Shook et al. | |
| 5,253,731 | A * | 10/1993 | Moog | E01D 19/106 182/2.6 |
| 5,435,410 | A | 7/1995 | Langston | |
| 2008/0053750 | A1* | 3/2008 | Tseng | A62B 1/02 182/82 |
| 2012/0006619 | A1 | 1/2012 | DuBose | |
| 2013/0313045 | A1 | 11/2013 | Jorkama-Lopez et al. | |
| 2016/0177584 | A1* | 6/2016 | Hyvonen | E01D 22/00 182/141 |

FOREIGN PATENT DOCUMENTS

| | | | |
|---|---|---|---|
| GB | 2106074 | A | 4/1983 |
| JP | S62-6006 | | 1/1987 |
| JP | H0544202 | A | 2/1993 |
| JP | H1121822 | A | 1/1999 |
| WO | 91-03603 | | 3/1993 |
| WO | WO 2012062968 | A1 | 5/2012 |
| WO | WO 2015018979 | A1 | 2/2015 |

* cited by examiner

SCAFFOLD FOR SUPPORTING A WORKING PLATFORM FOR BRIDGES

FIELD OF THE INVENTION

The present invention relates to scaffolding used for forming working platforms and support structures necessary for work used in connection with repair, installation and maintenance work of bridges and other deck-like structures.

The invention especially relates to forming of repair scaffolding for bridges.

BACKGROUND OF THE INVENTION

Publication WO2008132277 discloses a scaffolding arrangement suitable for bridge deck repair work. The arrangement comprises a number of scaffolding brackets installed on the deck of the bridge, the brackets being supported to bridge by bolting the bracket onto the upper surface of the bridge deck and subsequently supporting the bracket by means of a turnable support member to the lower surface of the bridge deck.

Publication WO2012062968 discloses a fastening means for fastening a scaffolding bracket to the deck of a bridge. The scaffolding bracket to be attached is arranged to be supported by two support points above the bridge deck. At least one of the support points is arranged to receive compression force from the attachment means attached to the bridge deck and at least one is arranged for tension force. The attachment means is arranged for removable attachment to the bridge deck by means of at least two attachment means and it comprises at least one attachment member for attaching the attachment means to the support point receiving the scaffolding bracket as tension force.

As the scaffolding brackets must be able to support a fairly large load formed by repair tools, employees and possibly casting moulds and the like, the brackets can easily become quite massive. Thus, lifting means are needed for handling them and heavy vehicles are needed for transporting them. Additionally, installation of the brackets usually requires a number of persons. All these increase the repair costs.

Another factor slowing down the repair work and increasing the costs is that the vertical adjustment travel of the scaffolding in relation to the bridge deck is quite small. Additionally, in some cases lifting the support platform in relation to the bridge deck causes it to tilt, which either makes work more difficult or must be somehow compensated. Due to the heavy loads all adjustment means and actuators must be heavily dimensioned, which further increases the weight and cost of the structure.

Scaffolding also requires special fastening apparatuses, such as bolts through the bridge deck and possibly a smooth surface on the deck for fastening. The moulds needed for repairing and casting the edge of the bridge must be moved by means of jacks and continuous casting in the longitudinal direction of the bridge or deck is not possible. Working is also made more difficult by the required support against the lower surface of the bridge.

The aim of the present invention is to provide a solution in which the location of the support platform formed by the scaffolding can easily be moved vertically.

The aim of the invention is also to provide a solution in which vertical adjustment doesn't change the sideways position.

Further, it is the aim of the embodiments of the invention to provide a scaffolding having an adjustable location of the support platform.

Further, the aim of the embodiments of the invention is to provide a scaffolding having a simple structure and being easy to manufacture.

The aim of the embodiments of the invention is to allow adjustment of the location of working platforms of the scaffolding, moulds and other structures in a wide range at least in the vertical direction of the bridge deck, preferably also in direction transverse to the longitudinal direction of the deck level.

The aim of the embodiments of the invention is to allow the vertical adjustment of the position in relation to the deck of the bridge or other surface at least partly from on top the deck of the bridge or other surface, most preferably from the side of the edge of the deck opposite to the fastening body of the scaffolding.

The invention is based on the scaffolding comprising boom system and means for attaching the boom system to the deck of the bridge or other corresponding structure having adjustment means for adjusting the position of the boom system and the boom system comprising at least one vertical boom being fastened to the means for adjusting the position of the boom system with lugs, each having one row of holes with a first interval between the holes, the vertical boom having a row of holes with a different interval between the holes than that between the holes of the lugs.

According to one embodiment of the invention the intervals between the holes of the vertical boom are longer than the intervals between the holes of the lugs.

According to one embodiment of the invention the vertical boom and the support beam are fastened to each other through lugs located at the end of the vertical boom, the lugs each comprising one row of holes with a first interval between the holes, and the support beam having a row of holes, in which the interval between holes is different from that between the holes in the lug.

According to one embodiment of the invention the intervals between the holes of the carrier beam are longer than the intervals between the holes of the lugs of the vertical boom.

According to one embodiment either the lower beam or the upper beam or both extend to the opposite side of the swivel point between the fastening body and the lower beam in relation to the vertical boom so that the lower beam forms a lever on both sides of the lower swivel point of the fastening body.

According to one embodiment the end of the lever formed by either the lower or upper beam or both, on the opposite side of the swivel point between the fastening body and the lower beam relative to the vertical boom, is provided with at least one actuator from the group of hydraulic jack or screw jack.

According to one embodiment of the invention the scaffolding can be disassembled into its component parts and assembled on site.

According to one embodiment of the invention one scaffolding unit comprises two actuators for changing and locking the vertical position of the carrier beam.

A number of advantages are achieved by means of the invention.

The structure of the scaffolding according to the invention is light but it can still be dimensioned to support a large load needed for carrying the apparatuses and supplies used in bridge repair work. The scaffolding is easy to disassemble into its component parts for transport and to assemble on site. No heavy lifting equipment is needed for moving the components and the installation of the scaffolding can be performed by even a single installer. One of the most important advantages of the invention is that the location of the support platform formed by means of the scaffolding can be easily changed within a large range in relation to the lower surface of the bridge without an essential change of the angle of the support platform or its distance from the edge of the bridge deck. The components of the scaffolding are plate and beam structures, whereby it is inexpensive to construct. In principle the assembly of the scaffolding only requires installation of the swivel pins, so the installation work is easy and no special tools are needed.

In the following, the invention is disclosed in more detail by means of reference to the appended drawings.

In the following, the downwards direction is the direction towards the upper surface of the deck structure from above it and the upwards direction is a direction opposite to it.

The following is a description of an advantageous method of adjusting the location of the boom system by means of a swivel quadrangle. This invention can be applied with other adjustment methods as well, such as in systems having a number of legs or adjustment means with variable or adjustable length. The structure described in the following is, however, a simple one and it is especially suitable for use with the invention, as will be obvious from the description. Most preferably the used swivel quadrangle is a swivel trapezoid, as in the following examples.

Figure 1:
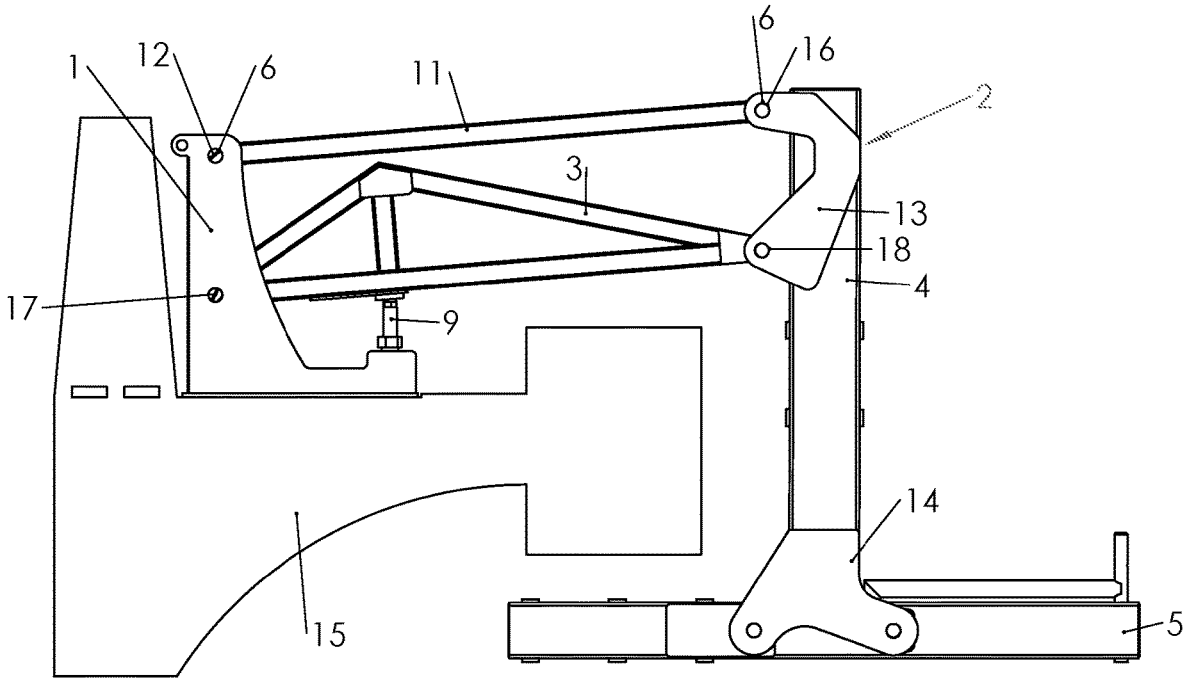
FIG. 1 illustrates a scaffolding used in connection with the solution in a side view.
Figure 2:
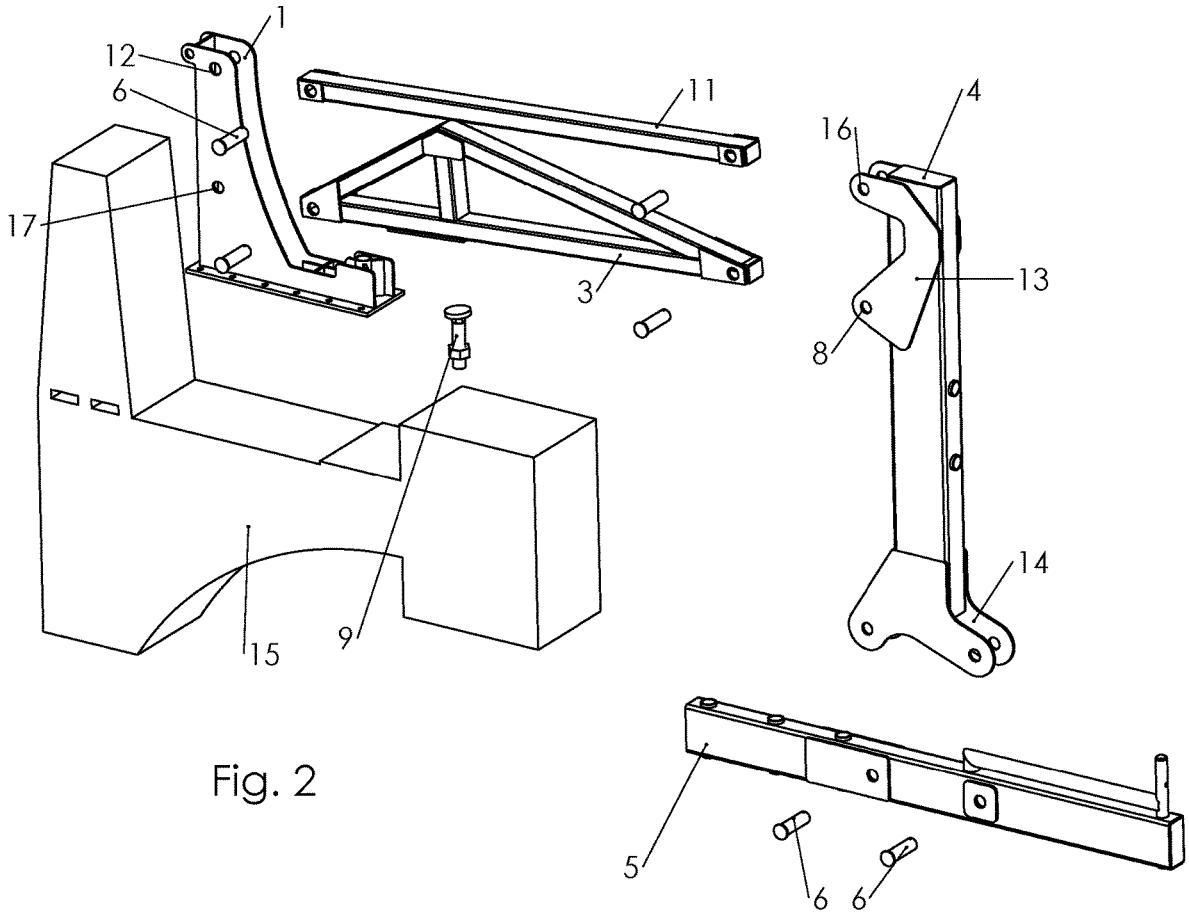
FIG. 2 is an exploded view of the scaffolding of FIG. 1.

In the embodiment of FIG. 1 the scaffolding comprises a support boom system 2 for forming working platforms and for supporting machines and moulds used for work as well as a fastening body 1 for connecting the boom system to the upper surface of the bridge or other deck structure 15 and for adjusting the position and location of the scaffolding. The boom system 2 comprises a vertical boom 4 the lower end of which is provided with a transverse support beam 5 forming a T-shaped structure at the end of the vertical boom. One of the branches to the T is installed to point towards the deck 15 of the bridge whereby the other branch points away from the deck. The workers' pathways can be arranged to be supported by these branches and the installations needed by the tools and moulds can be arranged on the side of the bridge deck.

The opposite end of the vertical boom 4 is provided with a swivel quadrangle formed by two beams, the upper beam 11 of which is a straight box girder, fastened at its end by swivel point 16 to the end of the vertical beam 4 and extending therefrom towards the fastening unit. A lower parallel beam 3 is located underneath the upper beam 11. Here, the lower beam 3 is a triangular girder comprising a straight lower beam and a triangle formed over the lower beam and consisting of two diagonal beams and a vertical support connecting the apex of the triangle and the lower beam. The advantage of this beam structure is its lightness and good load capacity.

The upper and lower beam 3, 11 are fastened to the fastening body 1 through swivel pins 6 at swivel points 12 and 17 located at a distance from each other so that the upper beam 11 is fastened to the upper part of the fastening body 1 at swivel point 12 and the lower beam 3 is fastened below it at swivel point 17 in the lower part of the fastening body 1. Here, the swivel points 12 and 17 are on the same vertical line, but the movement paths of the boom system can be changed by changing the locations of the swivel points, if necessary. At its opposite end the upper and lower beam 3, 11 are fastened by swivel pins 6 to lugs 13 located at the end of the vertical beam 4, the lugs being also provided with superimposed swivel points 16, 18 located vertically on the same line for the upper beam 11 and the lower beam 3. Thus the swivel points 12, 16, 17 and 18 form, together with the lower and upper beam 3, 11, a swivel quadrangle by means of which the vertical beam 4 and the transverse support beam 5 can be moved in vertical direction. The transverse support beam 5 is fastened by means of swivel pins 6 to lugs 14 located at the lower end of the vertical beam. In this fastening method the transverse support beam 5 is locked in horizontal position and the purpose of the pin fastening is to provide a joint that is easy to assemble.

The fastening body 1 can comprise fastening plates forming a foot assembly preferably comprising vertically adjustable fastening bolts for fastening the scaffolding to the bridge deck. The fastening bolts can be located in holes bored to the bridge deck and secured by chemical bonding to achieve a strong and reliable fastening.

The swivel quadrangle allows lifting and lowering of the vertical beam 4 and the transverse support beam 5 attached thereto. In this embodiment the actuator is a jack 9 installed on the fastening body 1 between the fastening body 1 and the triangular lower beam 3 of the swivel quadrangle. The jack 9 is arranged at the vertical support located at the apex of the beam triangle whereby a sturdy workplace can be provided for the jack 9. The jack 9 can be a simple screw jack, a hydraulic jack or other corresponding lifting device. As there is no need for continuous adjustment of height position, the jack can be a simple and sturdy apparatus.

Figure 3:
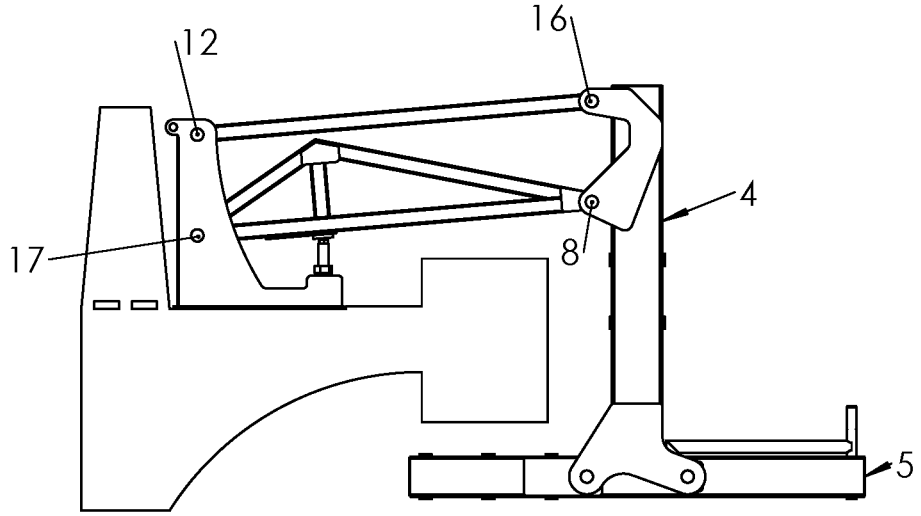
FIG. 3 illustrates the scaffolding of FIGS. 1 and 2 in the first adjustment position.
Figure 4:
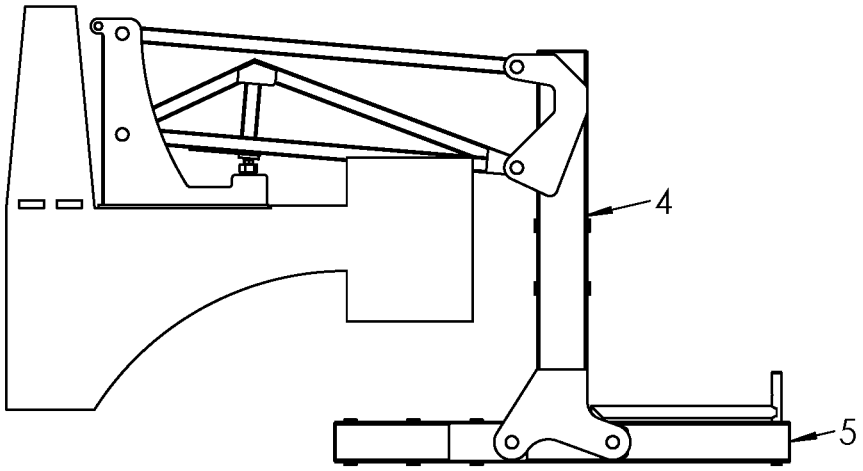
FIG. 4 illustrates the scaffolding of FIGS. 1 and 2 in the second adjustment position.

FIG. 3 shows the scaffolding in its uppermost position and FIG. 4 shows it in the lowermost position. As can be seen in the figures, the vertical boom 4 of the scaffolding stays exactly vertical even in the extreme positions and the support beam 5 stays horizontal. It can additionally be seen that the adjustment travel of the height adjustment is quite large. This is a very important advantage compared to previously known solutions, because in them the adjustment travel has been rather limited and the adjustments have been difficult to make.

Figure 5:
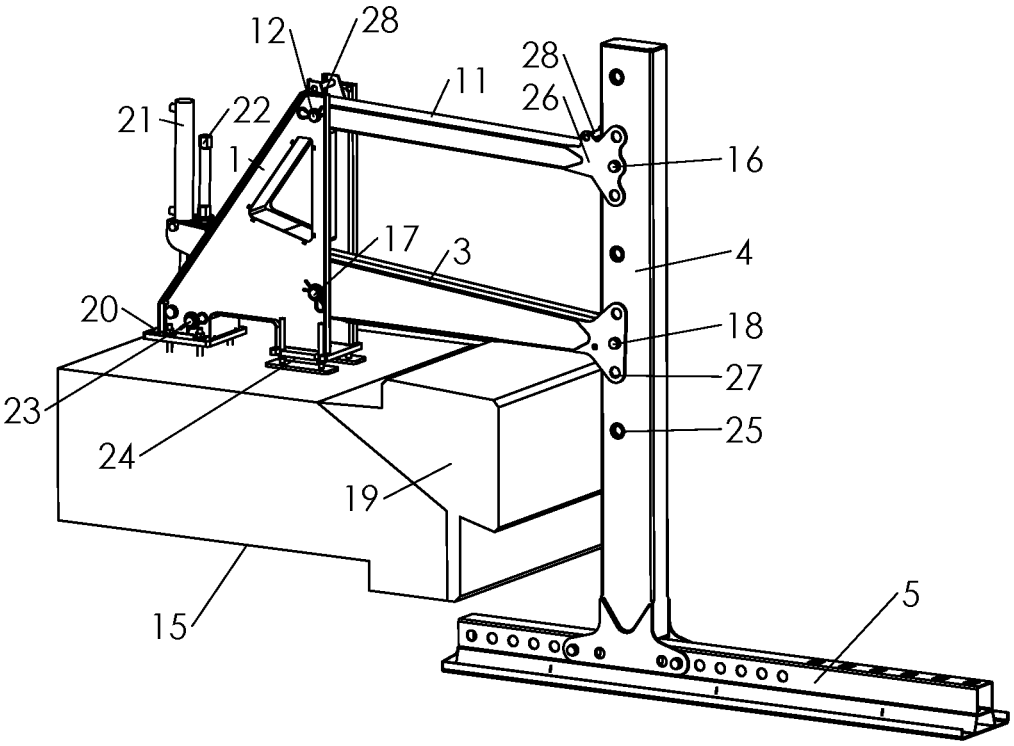
FIG. 5 is an illustration of an embodiment of the invention.

The scaffolding of FIG. 5 differs somewhat from what is described above. Firstly, the lower beam 3 of the scaffolding is in one piece, not necessarily straight and it extends to the opposite side of the swivel point 17 between the fastening body and the lower beam 3 in relation to the vertical beam 4. The lower beam 3 thus forms a lever on both sides of the lower swivel point 17 of the fastening body 1. The end of this lever, also on the opposite side of the swivel point 17 of the fastening body 1 and lower beam 3 in relation to the vertical beam 4, is provided with a hydraulic jack 21 and a screw jack 22. The shafts of the jacks 21, 22 are supported by the pedestal 20 of the fastening body 1. Both jacks can be independently used for adjusting the position of the vertical boom 4 and the support beam 5 by means of the lever formed by the lower beam 3, but preferably the adjustment is made by means of the hydraulic jack and the position of the scaffolding is locked by means of the screw jack 22. Here, hydraulic jack and screw jack mean any hydraulically operated or screw-operated actuator, the change of length of which causing a compression or tension force or locking to place. If desired, the adjustment and locking of position can be made by only using the screw, but the hydraulic jack can be used for assistance in height adjustment or simultaneously with the screw. Other actuators or power tools are not needed here. The adjustment can be easily and safely carried out at the side of the fastening body opposite to the edge of the deck.

The lever can also be formed at the upper beam or both the lower and upper beam. The jacks can be attached to different levers or the same lever according to the chosen configuration.

The scaffolding (fastening body 1) is preferably fastened to the deck of the bridge or other structure by means of threaded bolts 23 at pedestal 20. The fastening to the deck is accomplished by gluing or casting the bolts to blind holes made into the deck. The fastening is made at two pedestals 20 located at a distance from each other and the threaded bolts allow the scaffolding to be lifted up from the deck so that a clearance 24 is formed between the scaffolding and the deck. Thus it is possible to work the surface of the deck and the surface can be cast while the scaffolding is fastened. The fastening body can comprise a spirit level or levels for facilitating the adjustment of its position.

The vertical positioning of the scaffolding to the deck of the bridge or other structure is in this embodiment carried out, in addition to the swivel quadrangle, by changing the locations of the fastening points (swivel points) 16 and 18 between the vertical beam 4 and the swivel quadrangle 12, 16, 17 and 18. The vertical boom 4 comprises superimposed fastening holes 25 at defined intervals. Lugs 26 are provided at the ends of the upper and lower beam 11, 3, the lugs being arranged on both sides of the vertical boom and also having superimposed fastening holes 27, also at defined intervals. The intervals between the fastening holes 25 of the vertical boom are longer than the intervals between the fastening holes 27 of the lugs 26. This provides a large adjustment travel by means of the fastening holes 25 of the vertical boom 4 and a smaller adjustment range by means of the fastening holes 27 of the lugs 26. When this adjustment method is combined with adjustment by the swivel quadrangle, the position of the scaffolding can be set as desired within a very wide range. This allows e.g. easy and accurate positioning of the mould for the edge casting 19 of the bridge.

The adjustment of the location of the support beam 5 in relation to the edge of the bridge or other deck can be accomplished by means of a corresponding hole distribution. FIG. 5 illustrates a dense hole distribution in support beam 5 and four holes in the fastening lugs of the vertical beam. This hole distribution is flexible and the size and distribution of the holes can be changed for producing a sufficient adjustment precision. Even though a dense hole distribution can also be provided to long load-carrying parts, such as the vertical boom or the support beam, it is more advantageous to use a larger hole distribution in them for minimizing the amount of holes and maintaining strength.

The features of the above-mentioned embodiments can well be combined and corresponding parts can be replaced by other ones for achieving the structure most suitable for each application.

The scaffolding can comprise integrated workbenches and they can have rails or fasteners for moulds, tools, such as water cutters, or handrails. The scaffolding can be fastened to a rail on the bridge deck so that it can be moved parallel with the deck as the work progresses. The fastening parts can have toolboxes for safe storage of tools and other supplies and the scaffolding can be provided with lifting hooks or the like so that it can be moved as a complete system.

The scaffolding according to the invention can be transported to the site as already assembled or disassembled into its main components. The scaffolding is assembled by simply installing swivel pins 6 into their places and by locking them with cotter pins. Thus, in principle no tools are needed for assembling the scaffolding. The scaffolding is easy to disassemble into relatively light parts and to transport to a new site after use. As a number of scaffolding unit are needed for the bridge deck or other corresponding application, easy assembly, disassembly and transportation provides considerable advantages. Instead of swivel pins and cotter pins other corresponding fastening means, such as bolts and nuts, can be used.

It is obvious that the various parts of the above-described example can be replaced by their functional and structural equivalencies within the definitions of the appended claims.

The invention claimed is:

1. A scaffolding to be fastened to a bridge or a corresponding deck structure, comprising:

a boom system for supporting working platforms and support structures needed for work;

a fastening body (1) for fastening the boom system to an upper side of the deck structure, the fastening body (1) having an upper swivel point (12) and a lower swivel point (17) located underneath the upper swivel point (12), the boom system comprising a vertical boom (4) and a transverse support beam (5), the vertical boom (4) being provided with an upper swivel point (16) and a lower swivel point (18) located underneath the upper swivel point (16) of the vertical boom (4), a lower end of the vertical boom (4) being provided with the transverse support beam (5) and forming a T-shaped structure at the lower end of the vertical boom (4), one branch of the T-shaped structure being installable to point towards the deck structure (15) with another branch of the T-shaped structure pointing away from the deck structure (15);

a swivel quadrangle provided on an upper end of the vertical boom (4), the boom system being connected to the fastening body via the swivel quadrangle; and adjustment means for adjusting a position of the boom system, wherein the swivel quadrangle comprises an upper beam (11) and a lower beam (3), one end of the upper beam (11) being connected to the upper end of the vertical boom (4) at the upper swivel point (16) of the vertical boom (4), the upper beam (11) extending from the upper swivel point (16) of the vertical boom (4) towards and connected to the fastening body (1) at the upper swivel point (12) of the fastening body (1), the lower beam (3) being parallel to the upper beam and located underneath the upper beam (11), a first end of the lower beam (3) being connected to the upper end of the vertical boom (4) at the lower swivel point (18) of the vertical boom (4), the lower beam (3) extending from the lower swivel point (18) of the vertical boom (4) towards and connected to the fastening body (1) at the lower swivel point (17) of the fastening body (1), wherein the lower beam (3) continues to extend away from the vertical boom (4) beyond the lower swivel point (17) of the fastening body (1) with a second end of the lower beam (3) being fastened to the adjustment means for adjusting the position of the boom system, the first end of the lower beam (3) being connected to the vertical boom (4) on a first side of the lower swivel point (17) of the fastening body (1) and the second end of the lower beam (3) being fastened to the adjustment means for adjusting the position of the boom system on an opposite, second side of the lower swivel point (17) of the fastening body (1), and wherein, by the first end of the lower beam being connected to the vertical boom (4) at the lower swivel point (18) of the vertical boom (4), an intermediate part of the lower beam being connected to the fastening body (1) at the lower swivel point (17) of the fastening body and the second end of the lower beam being fastened to the adjustment means for adjusting the position of the boom system, the lower beam forms a lever extending on both sides of the lower swivel point (17) of the fastening body, and wherein the adjustment means comprises at least one actuator arranged at the second end of the lower beam, the at least one actuator being located on the opposite, second side of the lower swivel point (17) of the fastening body (1), the adjustment means being operable for adjusting a position of the second end of the lower beam and a position of the vertical boom connected to the first end of the lower beam.

2. The scaffolding according to claim 1, further comprising lugs that fasten the first end of the lower beam and the one end of the upper beam to the vertical boom, each of the lugs having one row of holes, in which there is a first interval between the holes of each lug, the vertical boom having a row of holes in which an interval between holes of the vertical boom is different from the first interval between the holes of the lugs.

3. The scaffolding according to claim 2, wherein the interval between the holes of the vertical boom is longer than the first interval between the holes of the lugs.

4. The scaffolding according to claim 2, wherein the vertical boom and the transverse support beam are fastened to each other via further lugs located at the lower end of the vertical boom, the further lugs each having a row of holes and the transverse support beam having a row of holes, an interval of the row of holes in the further lugs being different from an interval of the row of holes in the transverse support beam.

5. The scaffolding according to claim 1, wherein the upper and lower swivel points of the fastening body are on a same vertical line and the upper and lower swivel points of the vertical boom are on another same vertical line.

6. The scaffolding according to claim 1, wherein the at least one actuator comprises at least one of the group consisting of a hydraulic jack and a screw jack for adjusting a position of the swivel quadrangle and the boom system connected thereto.

7. The scaffolding according to claim 1, wherein the upper and lower swivel points of the fastening body and the upper and lower swivel points of the vertical boom comprise removable connection members.

8. The scaffolding according to claim 7, wherein the connection members are swivel pins.

9. The scaffolding according to claim 1, wherein the swivel quadrangle is a swivel parallelogram.

10. The scaffolding according to claim 1, wherein the at least one actuator comprises a hydraulic jack located at the second end of the lower beam on the opposite, second side of the lower swivel point (17) of the fastening body (1), the hydraulic jack being operable for adjusting the position of the second end of the lower beam and the position of the vertical boom connected to the first end of the lower beam.

11. The scaffolding according to claim 1, wherein the at least one actuator comprises a screw jack located at the second end of the lower beam on the opposite, second side of the lower swivel point (17) of the fastening body (1), the screw jack being operable for adjusting the position of the second end of the lower beam and the position of the vertical boom connected to the first end of the lower beam.

* * * * *